United States Patent [19]

Van Sloun

[11] Patent Number: 4,461,201

[45] Date of Patent: Jul. 24, 1984

[54] SAFETY CLOSURE LOCK

[75] Inventor: Peter H. Van Sloun, Hopkins, Minn.

[73] Assignee: Honeywell Inc., Minneapolis, Minn.

[21] Appl. No.: 480,969

[22] Filed: Mar. 31, 1983

[51] Int. Cl.[3] ..... F41F 1/00

[52] U.S. Cl. ..... 89/1 R; 292/258

[58] Field of Search ..... 89/1.5 R, 1.5 F, 1 R, 89/1 B, 1.8 M; 292/258, 256.65, 256.69

[56] References Cited

U.S. PATENT DOCUMENTS 2,120,047 6/1938 Turner ..... 292/258

2,524,632 10/1950 Morrison ..... 292/258

4,134,328 1/1979 Asp et al. ..... 89/1.817

FOREIGN PATENT DOCUMENTS 173287 11/1960 Sweden ..... 292/258

*Primary Examiner*—David H. Brown

*Attorney, Agent, or Firm*—Roger W. Jensen

[57] ABSTRACT

A safety closure lock apparatus for preventing unintended ejection of submunitions from a munitions canister tube comprising a bridle assembly adapted to be applied over the muzzle end of the canister tube at a point of time following the loading of the submunitions.

25 Claims, 7 Drawing Figures

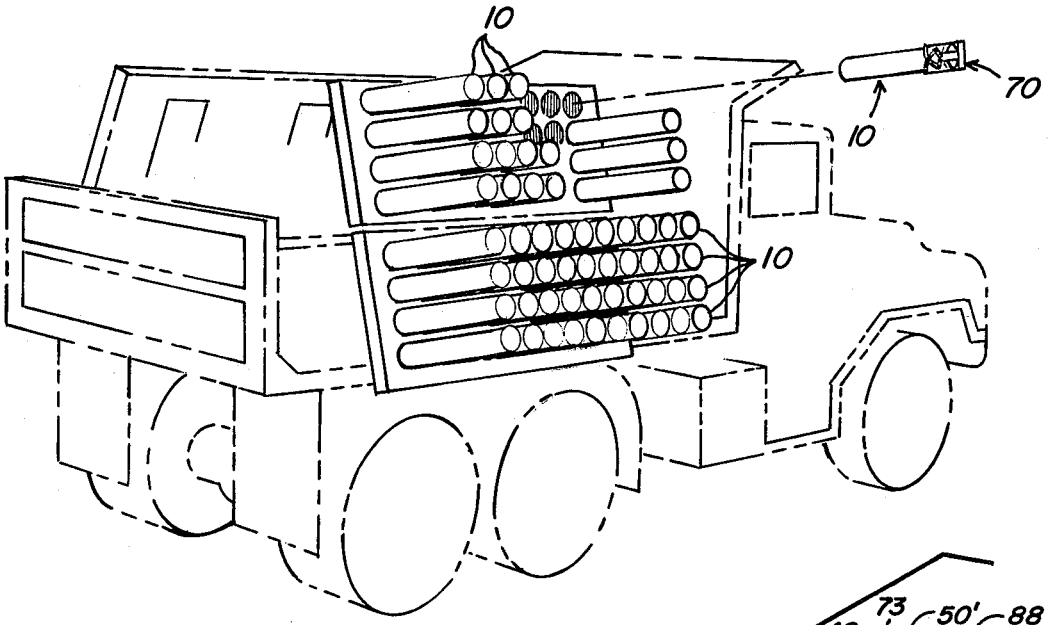
FIG. 1
FIG. 2
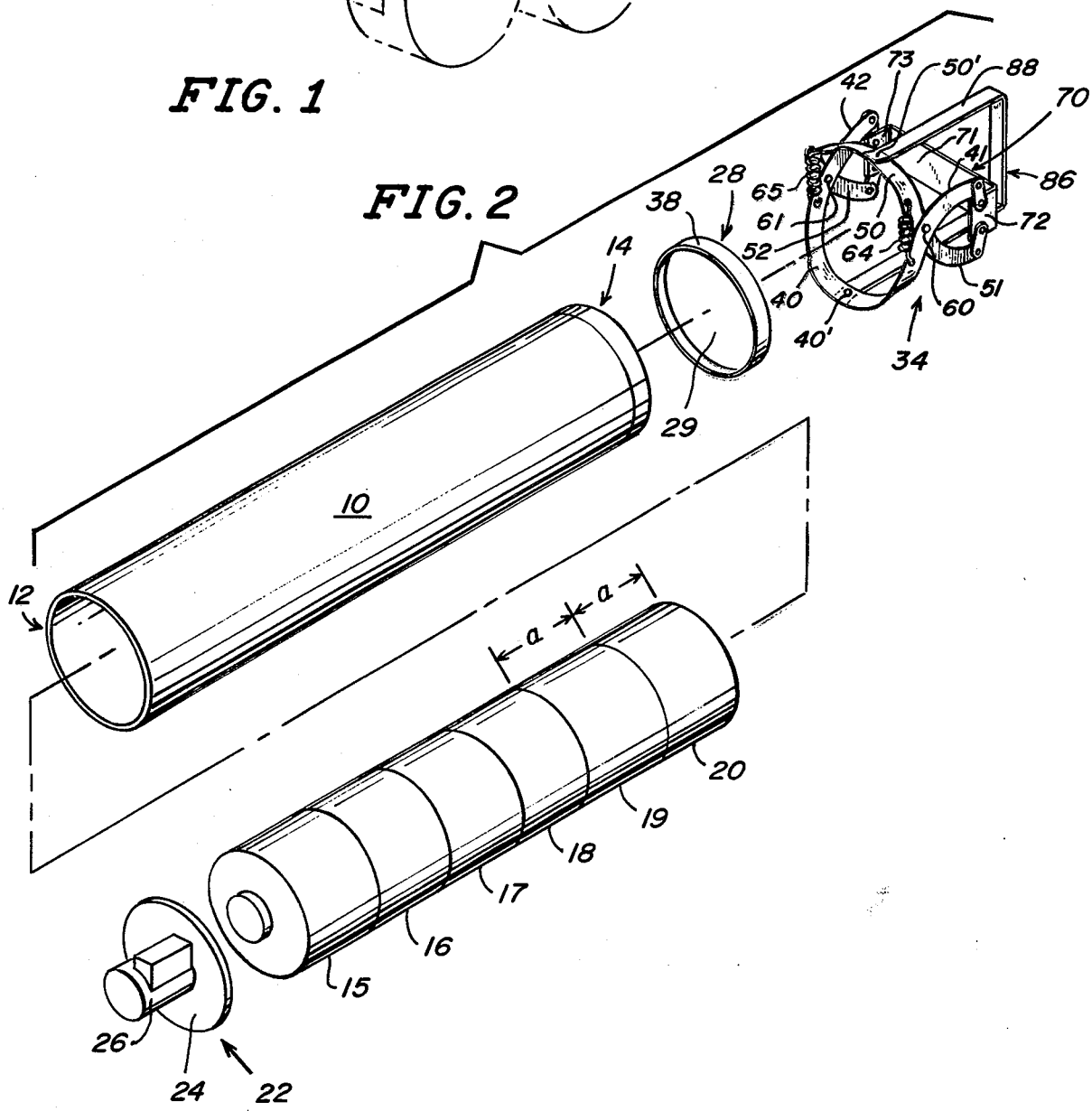

SAFETY CLOSURE LOCK

BACKGROUND OF THE INVENTION

Within the field of delivery of submunitions there have been a number of prior art arrangements whereby submunitions, e.g., land mines, are stored in right-circular cylindrically shaped canister tubes. At an intended time, the submunitions are adapted to be ejected from said tube by a propulsion charge. An example of a prior art arrangement is the apparatus disclosed in my previously filed co-pending patent application, Ser. No. 394,086, filed July 1, 1982 for "DISPERSING MINE DISPENSER".

The submunitions contained within the canister tubes are relatively safe as long as they are in such tubes; however, upon ejection from the tube, then they typically become armed through automatic means known to those skilled in the art, e.g., boreriders, impact and/or spin actuation means, etc.

A serious problem with such submunitions is that the propulsion means for ejecting the submunitions from the canister tube could unintentionally, i.e., by accident, become activated so as to try to eject the submunitions from the canister tubes. It will be understood that if the preceding occurred, i.e., an unintended ejection of the submunitions, then there could be great danger and/or death, injury, or damage to personnel and/or property. There has been prior art, rather unsatisfactory attempts to provide some measure of safety to prevent the aforesaid ejection of the submunitions from the tubes prior to the intended time. For example, one arrangement was to use a pallet-like assembly which closely abutted the ends of the loaded canister tubes so as to prevent such unintended ejection. The pallet arrangement has been found very unsatisfactory because, among other things, the pallet cannot be installed adjacent the ends of any single tube until all of the tubes in the total configuration have been assembled on the launching means, e.g., mobile launcher. It is a broad object of my invention to alleviate this problem by providing an improved safety closure lock for a canister tube containing submunitions.

BRIEF STATEMENT OF THE INVENTION

My invention provides a safety closure lock to constrain submunitions within a canister tube notwithstanding an unintentional actuation of the propulsion means for ejecting the submunitions from the tube. My invention briefly comprises a bridle apparatus which is applied over the open end of the canister tube, which bridle apparatus will prevent an unintended ejection of the submunitions within the tube.

BRIEF DESCRIPTION OF THE DRAWINGS

FIG. 1 shows, partly in phantom, a military vehicle serving as a mobile platform for a large plurality of canister tubes;

FIG. 2 depicts an exploded view of a canister tube, submunitions to be inserted therein, an optional canister tube end cap, and a bridle apparatus for providing a safety closure lock for the tube and submunitions therewithin;

DETAILED DESCRIPTION OF THE PREFERRED EMBODIMENT OF THE INVENTION

Figure 3:
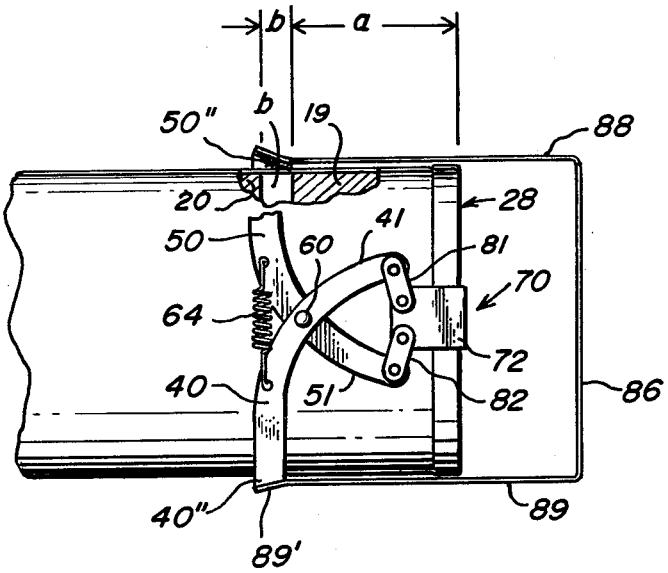
FIG. 3 shows the bridle apparatus applied over the end of an assembly of a canister tube, submunitions therewithin, and an end cap.

Referring to FIG. 2, a hollow right-circular cylindrically shaped canister tube 10 having open ends 12 and 14 is adapted to be loaded with a plurality of submunitions 15–20 through open end 12 thereof. Tube 10 may be made from a suitable metal such as aluminum alloy. An example of a tube with submunitions contained therewithin is apparatus disclosed in the aforementioned application, Ser. No. 394,086. A propulsion assembly 22 comprising end piece 24 and a central hub member 26 is adapted to be secured by means not shown to the open end 12 of the tube 10. Further, the central hub 26 contains propulsion means, not shown, which, when actuated, will generate propulsion gases intended to propel or eject the munitions 15–20 from end 14 of the tube 10. Munitions 15–20 may, for example, be anti armor and/or antipersonnel mines, the details of which are not specifically relevant to the present invention except that it will be noted from FIG. 2 that the munitions 15–20 are generally cylindrical in shape and have the same approximate axial length being nested within the canister in axial abutting relationship. In FIG. 2 the axial length of munition 20 is designated by the symbol "a". In FIG. 3, the length "a" is again depicted as is a short axial gap or void space "b" between adjacent submunitions, the gap "b" being present at least near the outer circumferential surfaces of two adjacent submunitions.

Figure 5:
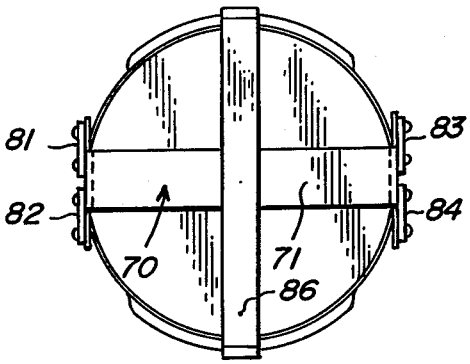
FIG. 5 is an end view of the apparatus shown in FIG. 3.

A circularly-shaped end cap 28 has a flat circular portion 29 and a skirt portion 38 of short axial length and is adapted to be fitted over the open end 14 of canister tube in reasonably snug but releasably fitting relationship. In FIG. 2 the reference numeral 34 generally designates a bridle assembly shown in greater detail in FIGS. 3–5. The bridle assembly comprises first and second bridle members 40 and 50, each of which is an elongated strap having first and second ends 41, 42 and 51, 52 respectively. The elongated straps may be fashioned out of any appropriate material, e.g., steel, having the requisite characteristics e.g. strength, corrosion resistance, etc., and may be of cross-sections other than that of a strap, e.g., fashioned from rods or bars having circular, square, or other unique cross-sections. The middle sections of both bridle members 40 and 50 are curved in a half circular shape as is perhaps best depicted in FIG. 2, the diameter of the half circular shapes being slightly greater than the diameter of the tube. Further, the bridle members have the ends thereof 41, 42 and 51, 52 curved away from the plane defined by the said half-circular shapes, this being clearly depicted in FIGS. 3 and 4. The first and second bridle members 40 and 50 are pivotally connected together for limited rotational movement therebetween at first and second pivot points 60 and 61; the pivot points are located intermediate the ends of the bridle members and the planes defined by the half-circular shapes as aforesaid.

A pair of spring means 64 and 65 are provided, each connected to both of said bridle members and respectively spaced from the first and second pivot points, 60 and 61. As shown, the spring means 64 and 65 are depicted to be tension springs each connected at their opposite ends to bridle members 50 and 40, the longitudinal axis of the tension springs being substantially in the plane defined by the circular portions of the bridle members.

A U-shaped lock band 70 having a bight portion 71 and first and second depending ends 72 and 73 is provided, the bight portion 71 (see FIG. 5) being slightly longer than the diameter of the end cap. The first and second depending ends 72 and 73 of the band 70 are adapted to be connected, via first and second pairs of link members 81, 82 and 83, 84 respectively to said first and second ends of said bridle members. For example, with reference to FIGS. 3 and 4, it will be seen that depending end 72 of the lock band 70 is connected to end 51 of bridle member 50 by the connecting link 82 and to end 41 of bridle member 40 by link 81. The link members are pivotally connected to the bridle members and to the depending ends of the lock bands in a way which permits limited rotational movement therebetween.

A U-shaped removal handle 86 having a bight portion 87 which is slightly longer than the diameter of the end cap 28 and first and second depending ends 88 and 89 which are securely connected at the extremities thereof respectively to the mid-points or centers 50' and 40' of the first and second bridle members 50 and 40. The axial length of the depending ends 88 and 89 are selected so that when the entire bridle assembly is applied over the end of the canister tube (with or without a end cover) the ends 88' and 89' of the depending ends 88 and 89 will be substantially in register with the gap or void space "b" between adjacent munitions within the canister 10.

Figure 6:
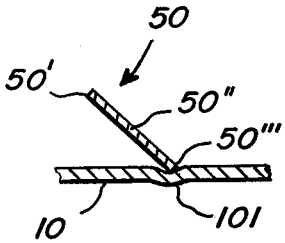
FIG. 6 is a detailed view of the engagement between the portion of the bridle apparatus and the side of the canister tube.
Figure 7:
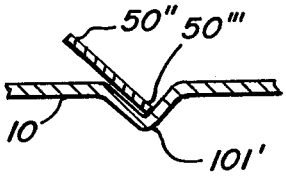
FIG. 7 is a view similar to FIG. 6 except with additional deformation of the tube being disclosed.

The bridle members 40 and 50 may be deformed at their mid-points 40' and 50' such as by a fractional twist of the members about their principle axes as is indicated by the reference numerals 40'' and 50'' (see FIGS. 3, 6 and 7). The surface portion of 50'' which is in engagement with the exterior surface of tube 10 is identified by reference numeral 50''' in FIGS. 6 and 7.

In FIG. 1, it will be noted that a truck-like vehicle has along one side thereof a large number of canister tubes 10 arranged in rows with their longitudinal axes parallel to one another.

OPERATION AND UTILIZATION OF THE INVENTION

At a submunitions loading facility, one or more canister tubes 10 will each be loaded with submunitions, e.g., 15–20 through the open end 12 thereof which end is then sealed off with the propulsion assembly 22 which contains, as aforesaid, propulsion means not shown. The use of end cap 28 is optional; in some cases end caps may not be required. Once the submunitions are loaded within the canisters, then it is critically important to insure that these submunitions will not be ejected from the canister tubes prior to an intended time because, as aforesaid, the submunitions may become automatically armed and/or detonated at the time of ejection or removal from the tubes or a predetermined time thereafter. The inherent risks to personnel and property are obvious.

The present arrangement provides a low cost, highly reliable way of assuring such unintended ejection from a time immediately after the loading of the submunitions into the canister tube. Referring to FIGS. 1, 2, 3, 4, and 5 in operation my bridle assembly is adapted to be slipped down over the end 14 of the canister tube, this being permitted by appropriate rotation between bridle members 40 and 50 about their pivot points 60 and 61 so as to permit such sliding of the bridle assembly down along the tube 10 to the point where the inside surface of the bight portion 71 of the lock band 70 is in firm abutting engagement with the axial end of the tube 10 (or, in the case of the use of an end cover 28, against the outer axial face of the cover 28). The sections 50'' and 40'' are in register with the gap or void "b". The tension springs 64 and 65 are selected so that when the bridle assembly is in the position shown in FIGS. 3, 4, and 5, there will be an appropriate pulling force exerted on the bridle members so that the deformations 50'' and 40'' are held tightly against the side of the tube 10. This gripping action can, if desired, be augmented by having a slight deformation 101 in the side wall of the tube 10, see FIG. 6.

As indicated, the apparatus depicted in FIG. 3 shows the bridle assembly in its normal position, i.e., the position of being "at rest" at the time of application of the lock closure following the loading of the submunitions. It will be observed in FIG. 3 that the links 81 and 82 connecting the depending end 72 and the end portions 41 and 51 are at substantial angles with respect to the longitudinal axis of the depending end 72, i.e., appear in FIG. 3 to be approaching right angles with respect to end 72.

Figure 4:
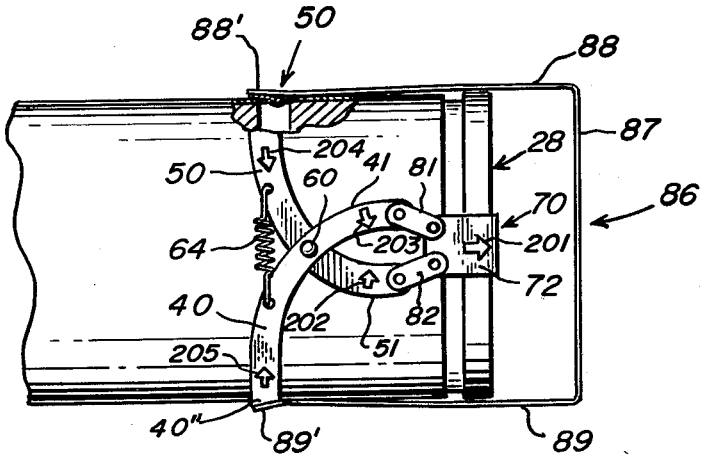
FIG. 4 depicts the apparatus of FIG. 3 after there has been an unintentional actuation of the propulsion means so as to try to eject the submunitions, the end cap being displaced in an outward axial direction outwardly from the position of FIG. 3 and the bridle apparatus being articulated by such outward axial motion.

In FIG. 4 the apparatus has been depicted as it would be following an unintended actuation of the propulsion means of the apparatus. Thus if the propulsion means contained within assembly 22 were unintentionally detonated, it will be understood that there will be a generation of propulsion gases which will tend to eject all of the submunitions 15–20 out of the canister tube 10. It will be noted in FIG. 4 that the cover member 28 has been displaced axially to the right in response to the shifting or movement to the right of the submunitions under the forces of the propulsion gases from the position shown in FIG. 3. However the cover 28 cannot move axially except to the extent permitted by corresponding axial movement of the lock band 70 and this latter axial movement is limited by the travel permitted by the linkages therebetween and the remainder of the bridle assembly. Because the deformations 50'' and 40'' are securely connected to the side wall of the canister tube 10, the only movement that can occur is that associated with the limited rotation of the links 81, 82 and 83, 84 with respect to the depending ends 72 and 73 and the bridle members 40 and 50. By close observation of the apparatus of FIG. 4, it will be seen that the angle between the links 81 and 82 and the axis of depending end 72 is much less than the angle shown in FIG. 3. It is this change which accounts for the slight axial movement of the cover 28 so as to safely vent the propulsion gases generated within by the unintended ignition of the propulsion means. However, a very important additional function occurs simultaneously with the slight axial movement of the lock band 70 as aforesaid, this additional important function being that the ends 41 and 51 of the bridle members are drawn toward one another which is translated via the pivots 60 and 61 into very large inward radial forces at the pressure points of the bridle members 40 and 50, i.e., at the points 50'' and 40'' to thereby increase the holding or gripping power of the bridle assembly to the side of the canister to thus prevent the ejection of the submunitions. To explain further, the outward force on the lock band is represented in FIG. 4 by the force vector 201, the inward forces on ends 41 and 51 by force vectors 203 and 202 respectively, and the radially inward forces on the bridle members 40 and 50 by force vectors 205 and 204 respectively. Those skilled in the art will appreciate that my invention provides a means of developing very large radial inwardly directed forces at these pressure points 40'' and 50'' which forces may be used, if desired, to actually produce a substantially deformation of the side wall of the canister tube 10, i.e., as shown in FIG. 7 and designated by the reference numeral 101'. This function may be further enabled by having the axial length "a" of an individual submunition, as shown in FIG. 2, coordinated with the axial length of the bridle assembly, i.e., the distance between the bight portion 71 of the lock band and the deformed portions 40'' and 50'' of the bridle members so that such pressure points occur at a point intermediate between two adjacent submunitions, i.e., at void zones "b" so that there is minimal resistance to such deformation of the surface of the tube.

As indicated above, the invention may not necessarily include the use of a cover member 28, it being recognized that the apparatus depicted in the figures includes such a cover. Further, the handle 86 is not required in all instances. The handle, although not essential, may conveniently be used to remove the safety closure lock.

I claim:

1. In combination with a hollow right-circular cylindrically shaped canister tube adapted to be loaded with submunitions which in turn are adapted to be ejected by a propulsion charge in said tube from an open end thereof, a safety closure lock for said canister tube to prevent an ejection of said submunitions from said tube prior to an intended time, but to permit a partial limited axial movement of said submunitions from said open end of said tube, said safety closure lock comprising:

(a) a bridle assembly including:

(i) first and second bridle members each of which is an elongated strap having first and second ends and the middle section thereof being curved in a half-circular shape and of a diameter slightly greater than the diameter of said tube, and said straps further having said first and second ends thereof curved away from the plane defined by said half-circular shape, said first and second bridle members being pivotally connected together for limited rotational movement therebetween at first and second pivot points located intermediate the ends of said members and the planes defined by said half-circular shapes, and (ii) first and second spring means each connected to both said bridle members and respectively spaced from said first and second pivot points;

(b) an "U" shaped lock band having a bight portion slightly longer than the diameter of said canister tube and first and second depending ends; and (c) first and second pairs of link members connecting respectively said first and second depending ends of said lock band to said first and second ends of said bridle members, said link members being pivotally connected to said bridle members and said depending ends for limited rotational movement therebetween;

whereby said safety closure lock facilitates the following:

(1) application of the entire safety closure lock over a preassembled tube and submunitions so that, (i) the bight portion of said lock band is abutting said open end of said canister tube, (ii) the centers of said first and second bridle members are engaging diametrically opposite sides of said tube at points axially spaced in from said open end thereof, whereat said spring means will draw said bridle members toward the exterior surface of said tube to provide a gripping action so that said safety closure lock will function both as a lock as aforesaid and also permit safe handling of said preassembled tube and submunitions, and so that following such handling the entire safety closure lock may be removed from said preassembled tube and munitions by application of an inward axial force to said bight portion of said lock band concurrently with an application of outward axial force to at least one of said bridle members at a point between said pivot points to thereby release the gripping of said tube by said bridle member, and (2) safety for personnel handling a preassembled tube and submunitions so that, if a propulsion charge within said tube is unintentionally ignited so as to try to eject said submunitions from said tube and if said safety lock enclosure is applied over said preassembled tube and submunitions as aforesaid an initial very limited axial movement of said submunitions (with respect to said tube) is permitted by said lock, such limited axial movement being equal to that of said bight portion of said lock band (abutted against said submunitions) and said axial movement of said lock band being translated, through the linkage of said link members and said bridle members, into very substantial gripping forces between said center sections of said bridle members and said tube.

2. Apparatus of claim 1 further characterized by said bridle members having inwardly extending protrusions to function as pressure point means so as to facilitate the gripping of the canister tube.

3. Apparatus of claim 1 further characterized by said spring means being tension springs connected between said first and second bridle members to spring load same to grasp said tube.

4. Apparatus of claim 2 further characterized by said bridle assembly being sized, in relation to said canister tube and the submunitions therein, so that said pressure point means bear on the external surface of said canister tube at a point between adjacent submunitions contained therewithin so as to permit an inward deformation of said tube.

5. Apparatus of claim 1 further characterized by said bridle members when assembled as aforesaid having said curved middle sections thereof substantially coplanar and circumferentially surrounding said tube.

6. Apparatus of claim 5 further characterized by said bridle members having inwardly extending protrusions to function as pressure point means so as to facilitate the gripping of the canister tube.

7. Apparatus of claim 5 further characterized by said spring means being tension springs connected between said first and second bridle members to spring load same to grasp said tube.

8. Apparatus of claim 7 further characterized by the axes of said tension spring being substantially coplanar with said curved middle sections of said bridle members.

9. In combination with a hollow right-circular cylindrically shaped canister tube adapted to be loaded with submunitions which in turn are adapted to be ejected by a propulsion charge in said tube from an open end thereof, and a circularly shaped end cap adapted to be placed over said open end; a safety closure lock for said assembled canister tube and end cap to prevent an ejection of said submunitions from said tube prior to an intended time but to permit a partial limited axial movement of said end cap away from said open end of said tube, said safety closure lock comprising:

(a) a bridle assembly including:

(i) first and second bridle members each of which is an elongated strap having first and second ends and the middle section thereof being curved in a half-circular shape and of a diameter slightly greater than the diameter of said tube, and said straps further having said first and second ends thereof curved away from the plane defined by said half-circular shape, said first and second bridle members being pivotally connected together for limited rotational movement therebetween at first and second pivot points located intermediate the ends of said members and the planes defined by said half-circular shapes, and (ii) first and second spring means each connected to both said bridle members and respectively spaced from said first and second pivot points;

(b) an "U" shaped lock band having a bight portion slightly longer than the diameter of said end cap and first and second depending ends; and (c) first and second pairs of link members connecting respectively said first and second depending ends of said lock band to said first and second ends of said bridle members, said link members being pivotally connected to said bridle members and said depending ends for limited rotational movement therebetween;

whereby said safety closure lock facilitates the following:

(1) application of the entire safety closure lock over a preassembled tube, submunitions, and end cap, so that, (i) the bight portion of said lock band is abutting the face of said end cap, (ii) the centers of said first and second bridle members are engaging diametrically opposite sides of said tube at points axially spaced in from said open end thereof, whereat said spring means will draw said bridle members toward the exterior surface of said tube to provide a gripping action so that said safety closure lock will function both as a lock as aforesaid and also permit safe handling of said preassembled tube, submunitions, and end cap, and so that following such handling the entire safety closure lock may be removed from said preassembled tube, submunitions and end cap by application of an inward axial force to said bight portion of said lock band concurrently with an application of outward axial force to at least one of said bridle members at a point between said pivot points to thereby release the gripping of said tube by said bridle members, and (2) safety for personnel handling a preassembled tube, submunitions, and end cap so that, if a propulsion charge within said tube is unintentionally ignited so as to try to eject said submunitions from said tube and if said safety lock closure is applied over said preassembled tube, submunitions and end cap as aforesaid in initial very limited axial movement of said end cap (with respect to said tube) is permitted by said lock, such limited axial movement being equal to that of said bight portion of said lock band (abutted against said end cap) and said axial movement of said lock band being translated, through the linkage of said link members and said bridle members, into very substantial gripping forces between said center sections of said bridle members and said tube, and said limited axial movement of said end cap permitting the venting of said tube and the harmless escape of propulsion gases.

10. Apparatus of claim 9 further characterized by said bridle members having inwardly extending protrusions to function as pressure point means so as to facilitate the gripping of the canister tube.

11. Apparatus of claim 9 further characterized by said spring means being tension springs connected between said first and second bridle members to spring load same to grasp said tube.

12. Apparatus of claim 10 further characterized by said bridle assembly being sized, in relation to said canister tube and the submunitions therein, so that said pressure point means bear on the external surface of said canister tube at a point between adjacent submunitions contained therewithin so as to permit an inward deformation of said tube.

13. Apparatus of claim 9 further characterized by said bridle members when assembled as aforesaid having said curved middle sections thereof substantially coplanar and circumferentially surrounding said tube.

14. Apparatus of claim 13 further characterized by said bridle members having inwardly extending protrusions to function as pressure point means so as to facilitate the gripping of the canister tube.

15. Apparatus of claim 13 further characterized by said spring means being tension springs connected between said first and second bridle members to spring load same to grasp said tube.

16. Apparatus of claim 15 further characterized by the axes of said tension spring being substantially coplanar with said curved middle sections of said bridle members.

17. In combination with a hollow right-circular cylindrically shaped canister tube adapted to be loaded with submunitions which in turn are adapted to be ejected by a propulsion charge in said tube from an open end thereof, and a circularly shaped end cap adapted to be placed over said open end; a safety closure lock for said assembled canister tube and end cap to prevent an ejection of said submunitions from said tube prior to an intended time but to permit a partial limited axial movement of said end cap away from said open end of said tube, said safety closure lock comprising:

(a) a bridle assembly including:

(i) first and second bridle members each of which is an elongated strap having first and second ends and the middle section thereof being curved in a half-circular shape and of a diameter slightly greater than the diameter of said tube, and said straps further having said first and second ends thereof curved away from the plane defined by said half-circular shape, said first and second bridle members being pivotally connected together for limited rotational movement therebetween at first and second pivot points located intermediate the ends of said members and the planes defined by said half-circular shapes, and (ii) first and second spring means each connected to both said bridle members and respectively spaced from said first and second pivot points;

(b) an "U" shaped lock band having a bight portion slightly longer than the diameter of said end cap and first and second depending ends;

(c) first and second pairs of link members connecting respectively said first and second depending ends of said lock band to said first and second ends of said bridle members, said link members being pivotally connected to said bridle members and said depending ends for limited rotational movement therebetween; and (d) an "U" shaped removal handle having a bight portion slightly longer than the diameter of said end cap and first and second depending ends connected at the extremities thereof respectively to the centers of said first and second bridle members;

whereby said safety closure lock facilitates the following:

(1) application of the entire safety closure lock over a preassembled tube, submunitions, and end cap, so that, (i) the bight portion of said lock band is abutting the face of said end cap, (ii) the centers of said first and second bridle members are engaging diametrically opposite sides of said tube at points axially spaced in from said open end thereof, whereat said spring means will draw said bridle members toward the exterior surface of said tube to provide a gripping action so that said safety closure lock will function both as a lock as aforesaid and also permit safe handling of said preassembled tube, submunitions and end cap, and so that following such handling the entire safety closure lock may be removed from said preassembled tube, submunitions and end cap by application of an inward axial force to said bight portion of said lock band concurrently with an application of outward axial force to at least one of said bridle members at a point between said pivot points to thereby release the gripping of said tube by said bridle members, and (2) safety for personnel handling a preassembled tube, submunitions, and end cap so that, if a propulsion charge within said tube is unintentionally ignited so as to try to eject said submunitions from said tube and if said safety lock closure is inserted over said preassembled tube and end cap as aforesaid an initial very limited axial movement of said end cap (with respect to said tube) is permitted by said lock, such limited axial movement being equal to that of said bight portion of said lock band (abutted against said end cap) and said axial movement of said lock band being translated, through the linkage of said link members of said bridle members, into very substantial gripping forces between said center sections of said bridle members and said tube, and said limited axial movement of said end cap permitting the venting of said tube and the harmless escape of propulsion gases.

18. Apparatus of claim 17 further characterized by said spring means being tension springs connected between said first and second bridle members to spring load same to grasp said tube.

19. Apparatus of claim 17 wherein the application of outward axial force to at least one of said bridle members is applied as an outward axial force to said bight portion of said handle and thence transmitted through said first and second depending ends of said handle to said centers of said first and second bridle members.

20. Apparatus of claim 17 further characterized by said bridle members having inwardly extending protrusions to function as pressure point means so as to facilitate the gripping of the canister tube.

21. Apparatus of claim 20 further characterized by said bridle assembly being sized, in relation to said canister tube and the submunitions therein, so that said pressure point means bear on the external surface of said canister tube at a point between adjacent submunitions contained therewithin so as to permit an inward deformation of said tube.

22. Apparatus of claim 17 further characterized by said bridle members when assembled as aforesaid having said curved middle sections thereof substantially coplanar and circumferentially surrounding said tube.

23. Apparatus of claim 22 further characterized by said bridle members having inwardly extending protrusions to function as pressure point means so as to facilitate the gripping of the canister tube.

24. Apparatus of claim 22 further characterized by said spring means being tension springs connected between said first and second bridle members to spring load same to grasp said tube.

25. Apparatus of claim 24 further characterized by the axes of said tension spring being substantially coplanar with said curved middle sections of said bridle members.

* * * * *